US012104869B2

(12) United States Patent
Tonkin

(10) Patent No.: US 12,104,869 B2
(45) Date of Patent: Oct. 1, 2024

(54) WEAPON BARREL HAVING INTEGRATED SUPPRESSOR

(71) Applicant: Eric T. Tonkin, Richmond, TX (US)

(72) Inventor: Eric T. Tonkin, Richmond, TX (US)

( * ) Notice: Subject to any disclaimer, the term of this patent is extended or adjusted under 35 U.S.C. 154(b) by 156 days.

(21) Appl. No.: 18/053,686

(22) Filed: Nov. 8, 2022

(65) Prior Publication Data

US 2023/0124066 A1 Apr. 20, 2023

Related U.S. Application Data

(63) Continuation of application No. 16/158,768, filed on Oct. 12, 2018, now abandoned, which is a continuation of application No. 14/672,997, filed on Mar. 30, 2015, now abandoned.

(60) Provisional application No. 62/021,548, filed on Jul. 7, 2014.

(51) Int. Cl.

| | |
|---|---|
| ***F41A 21/30*** | (2006.01) |
| ***F41A 21/02*** | (2006.01) |
| ***F41A 21/04*** | (2006.01) |
| ***F41A 21/24*** | (2006.01) |

(Continued)

(52) U.S. Cl.

CPC ..... *F41A 21/30* (2013.01); *F41A 21/02* (2013.01); *F41A 21/04* (2013.01); *F41A 21/24* (2013.01); *F41A 21/28* (2013.01); *F41A 21/482* (2013.01)

(58) Field of Classification Search

CPC ..... F41A 21/00; F41A 21/24; F41A 21/28; F41A 21/30; F41A 21/32; F41A 21/44; F41A 13/00

USPC ..... 89/14.05, 14.1, 14.4, 16; 42/76.01, 77, 42/78

See application file for complete search history.

(56) References Cited

U.S. PATENT DOCUMENTS

| | | | |
|---|---|---|---|
| 1,017,003 | A | 2/1912 | Kenney |
| 1,229,675 | A | 6/1917 | Thompson |

(Continued)

FOREIGN PATENT DOCUMENTS

| | | |
|---|---|---|
| EP | 2112452 | 4/2010 |
| WO | 00/57122 | 9/2000 |

(Continued)

OTHER PUBLICATIONS

Silencertalk, "Straight pull integrally silenced ar 15," Blog, posted Feb. 13, 2008, obtained from http://www.silencertalk.com/forum/viewtopic.php?t=19456 on Mar. 3, 2015.

(Continued)

*Primary Examiner* — Jonathan C Weber
(74) *Attorney, Agent, or Firm* — Lewis & Reese, PLLC

(57) ABSTRACT

A monolithic barrel for a weapon has an integral suppressor. The barrel and integral suppressor can be machined from a single piece of material, which can eliminate the need to attach separate components to the barrel. The monolithic barrel has a barrel bore for firing a projectile that produces discharge gas. To suppress the discharge, the barrel defines one or more baffles separating expansion chambers toward a distal end of the barrel. The barrel further defines one or more channels along the length of the barrel that provide extend flow paths for the discharge gas from the barrel's bore. Greater reductions in sound can be achieved relative to the overall barrel length due to the integral suppressor.

14 Claims, 7 Drawing Sheets

(51) Int. Cl.
*F41A 21/28* (2006.01)
*F41A 21/48* (2006.01)

(56) References Cited

U.S. PATENT DOCUMENTS

| | | | | |
|---|---|---|---|---|
| 2,274,239 | A * | 2/1942 | Hughes | F41A 21/36 89/14.3 |
| 2,801,416 | A | 8/1957 | Evans | |
| 2,872,848 | A | 2/1959 | Schuessler | |
| 2,883,781 | A | 4/1959 | Harvey | |
| 3,399,597 | A | 9/1968 | Perrine | |
| 3,677,132 | A | 7/1972 | Plenge | |
| 3,748,956 | A | 7/1973 | Hubner | |
| 3,858,481 | A | 1/1975 | Elliott | |
| 4,291,610 | A | 9/1981 | Waiser | |
| 4,852,460 | A * | 8/1989 | Davidson | F41A 21/36 89/14.05 |
| 5,136,923 | A | 8/1992 | Walsh, Jr. | |
| 5,355,765 | A | 10/1994 | Rogers | |
| 5,410,834 | A | 5/1995 | Benton et al. | |
| 5,811,714 | A * | 9/1998 | Hull | F41A 21/36 89/14.3 |
| 6,079,311 | A | 6/2000 | O'Quinn et al. | |
| 6,374,718 | B1 | 4/2002 | Rescigno | |
| 6,694,660 | B1 | 2/2004 | Davies | |
| 6,959,509 | B2 | 11/2005 | Vais | |
| 7,207,258 | B1 | 4/2007 | Scanlon | |
| 7,464,496 | B1 | 12/2008 | Davies et al. | |
| 7,832,323 | B1 | 11/2010 | Davies | |
| 8,025,003 | B1 | 9/2011 | Saur | |
| 8,069,604 | B2 | 12/2011 | Larue | |
| 8,171,840 | B2 | 5/2012 | Kline et al. | |
| 8,453,789 | B1 | 6/2013 | Honigmann et al. | |
| 8,479,632 | B2 | 7/2013 | Kline et al. | |
| 8,505,433 | B2 | 8/2013 | Hochstrate et al. | |
| 8,661,963 | B2 | 3/2014 | Patel | |
| D737,922 | S | 9/2015 | Pace | |
| 2003/0145718 | A1 | 8/2003 | Hausken et al. | |
| 2005/0262997 | A1 | 12/2005 | Brixius | |
| 2008/0156183 | A1 | 7/2008 | Brittingham | |
| 2010/0126054 | A1 | 5/2010 | Daniel et al. | |
| 2010/0126334 | A1 | 5/2010 | Shults et al. | |
| 2012/0080261 | A1 | 4/2012 | Shand | |
| 2012/0152649 | A1 | 6/2012 | Larue | |
| 2012/0174451 | A1 | 7/2012 | Overstreet et al. | |
| 2012/0246987 | A1 | 10/2012 | Anthony | |
| 2012/0291614 | A1 | 11/2012 | Koumbis | |
| 2013/0180149 | A1 | 7/2013 | Casas Salva | |
| 2014/0007481 | A1 | 1/2014 | Tresserras Torre et al. | |
| 2014/0157640 | A1 | 6/2014 | Whelan | |
| 2015/0090105 | A1 | 4/2015 | Pace | |
| 2015/0267986 | A1 | 9/2015 | Sellars | |
| 2015/0338184 | A1 | 11/2015 | White | |
| 2017/0261282 | A1 * | 9/2017 | Griffitts | F41A 21/36 |

FOREIGN PATENT DOCUMENTS

| | | |
|---|---|---|
| WO | 2012/098270 | 7/2012 |
| WO | 2015/048127 | 4/2015 |

OTHER PUBLICATIONS

Reflex Suppressors, "Telescopic Reflex Suppressor T8 Scout, " webpage, updated Mar. 4, 2009, obtained from http://guns.connect.fi/rs/mounting.html on Feb. 20, 2015.

Reflex Suppressors, "Reflex Suppressors for Rifles and Shotguns," webpage, updated Mar. 4, 2009, obtained from http://guns.connect.fi/rs/rifles.html on Feb. 20, 2015.

Reflex Suppressors, "Reflex Suppressors T8 Scout," picture from webpage, updated Nov. 15, 2001, obtained from http://guns.connect.fi/rs/mounting.html on Feb. 20, 2015.

Le Vieux, Renard, "Airsoft 2010—as real as it gets," Blog including drawing of "Sunina-Suomi" SS-II Silenced Barrel Unit, dated Jan. 28, 2013, obtained from http://airsoftbacau.blogspot.com on Feb. 20, 2015.

Reflex Suppressors, "Reflex Suppressors for Suomi SMG," webpage, obtained from http://guns.connect.fi/rs/suhin2gr.html on Feb. 20, 2015.

Shand, R., "Vacushot Sound and Flash Suppressor," webpage, copyright 2010, obtained from http://www.vacushot.com/ on Mar. 4, 2015.

Shand, R., "Sound and Flash Suppressor for Firearms," PowerPoint Presentation, undated, obtained from http://www.vacushot.com/ on Mar. 4, 2015.

Int'l Search Report and Written Opinion in counterpart PCT Appl. PCT/US15/39314, dated Dec. 22, 2015.

Houston Armory, "Introducing Houston Armory's Integrally Suppressed 300 Blackout Uppers!", obtained from http://www.ar15.com, last edited Nov. 6, 2012, generated Mar. 30, 2015.

Slowik, M., "Houston Armory's new H300IC integrally-suppressed 300 BLK upper", obtained from http://www.guns.com, dated Nov. 3, 2012, generated Mar. 30, 2015.

* cited by examiner 120
121c
52
150
142
140
144
121b
121a 120
121c
52
150
142
140
150
125
124
121b
121a 120
121c
150
142
140
121b
121a 121b
52
150
120
142
140
121a

WEAPON BARREL HAVING INTEGRATED SUPPRESSOR

CROSS REFERENCE TO RELATED APPLICATIONS

This application is a continuation of U.S. Non-Provisional patent application Ser. No. 16/158,768, filed Oct. 12, 2018, which is a continuation of U.S. Non-Provisional patent application Ser. No. 14/672,997, filed Mar. 30, 2015, which is a Non-Provisional of U.S. Provisional Application No. 62/021,548, filed Jul. 7, 2014. Priority is claimed to these applications, and they are incorporated herein by reference in their entireties.

BACKGROUND

Suppressors for guns have existed in various incarnations since at least the early twentieth century. Also known as silencers, suppressors serve to reduce noise associated with the firing of the gun. When used, the suppressor may also serve other functions, such as reducing or eliminating muzzle flash (the visible light of a muzzle blast caused by the combustion products of the gunpowder mixing with the ambient air) and reducing or eliminating blasts of high-pressure gasses escaping the muzzle, which can reveal a shooter's position by kicking up dust and foliage. While suppressor technology has applications in the realm of civilian firearms, it is especially important in the conduct of military operations. Indeed, combat is the arena in which suppressor performance is the most critical and it is also the environment that is the most taxing on equipment, including suppressor equipment.

FIG. 1A schematically illustrates a common suppressor concept. The suppressor 20 connects to a barrel 10 of a gun (not shown) by a connecting mechanism, such as a threaded section 12. The suppressor 20 uses a series of baffles 24 contained within a chamber 22 (often referred to as a "can") to slow the gasses that are expelled from barrel 10 after the projectile has exited the barrel 10. The slowing and dissipation of the pressure wave of gasses results in a decrease of audible report of the gunfire.

Another type of suppressor used in the art is an over-barrel suppressor, such as shown in FIG. 1B. The over-barrel suppressor 30 includes a jacket 32 that telescopes over the end of the barrel 10. A bushing arrangement 34 at one end can attach the jacket 32 to the barrel 10, and an intermediate mount 36 can support the jacket 32 at the distal end of the barrel 10. Extending beyond the muzzle of the barrel 10, the jacket 32 contains a reflector 37 and various baffles 38. The jacket 32 contains an expansion chamber 35 for gas that communicates with the muzzle extension portion having the reflector 37 and baffles 38.

While popular media, such as television and movies, would lead one to believe that gunfire from a silencer or suppressor like the ones illustrated in FIGS. 1A-1B is almost inaudible, reality is quite different. For example, a Remington XM2010 sniper rifle shooting .300 Winchester Magnum ammunition, as presently deployed by the United States Army in Afghanistan, has an unsuppressed audible report of about 168-DB. The presently deployed suppressor reduces the report to about 136-DB, significantly quieter, but still louder than a jackhammer or a jet aircraft.

Attachable/detachable suppressors, such as disclosed above, suffer from several drawbacks. One drawback is that the harmonics of the gun barrel changes when a suppressor is attached to the barrel or when one suppressor is replaced with another. When a gun is fired, the gun barrel vibrates. The vibration is a function of several characteristics of the barrel, including its length, tensile properties, and weight distribution. Additionally, when a gun is calibrated (i.e., sighted in), the barrel harmonics are implicit within that calibration. Adding a suppressor changes the weight distribution of the barrel, thereby changing the harmonics with which the barrel vibrates upon firing. That change will result in a change in the point of impact (POI) of the projectile on a target, compared to the POI of the unsuppressed gun. Thus, the gun must be re-sighted when a suppressor is added. Even if one suppressor is substituted for another similar suppressor, the barrel harmonics will be slightly different, requiring a re-sighting.

Another drawback of an attachable/detachable suppressor is that the point of attachment constitutes a structural weakness. Particularly in the rigors of combat, a gun barrel may be subjected to impacts, vibrations, torsions, and the like. Such stresses can compromise the attachment of the suppressor to the barrel, leading either to failure or to a decrease in accuracy.

The slight irreproducibility of suppressor attachment also negatively impacts accuracy because the trajectory of a projectile through the suppressor may become off center with respect to the baffles. As the projectile, travelling at high velocity, passes structures within the suppressor, pressure differentials are created between the structures and the projectile. If the projectile's path is not absolutely circumferential, the pressure differentials will not be completely symmetrical and will tend to pull the projectile in one direction. Small deviations in trajectory as the projectile leaves the suppressor translate to unacceptably large deviations downrange.

The subject matter of the present disclosure is directed to overcoming, or at least reducing the effects of, one or more of the problems set forth above.

SUMMARY

A monolithic barrel for a weapon has an integral suppressor. The barrel and integral suppressor can be machined from a single piece of material, which can eliminate the need to attach separate components to the barrel. By eliminating the need to attach such separate components, the disclosed barrel eliminates the problems discussed above, which primarily derive from the attachment mechanism.

The monolithic barrel has a barrel bore for firing a projectile that produces discharge gas. To suppress the discharge, the barrel defines one or more baffles separating expansion chambers toward a distal end of the barrel. The barrel further defines one or more channels along the length of the barrel that provide extended flow paths for the discharge gas from the barrel's bore. Greater reductions in sound can be achieved relative to the overall barrel length due to the integral suppressor.

These and other advantages will be apparent to a person of skill in the art in view of the following description and attached drawings. The foregoing summary is not intended to summarize each potential embodiment or every aspect of the present disclosure.

DETAILED DESCRIPTION

Figure 1A:
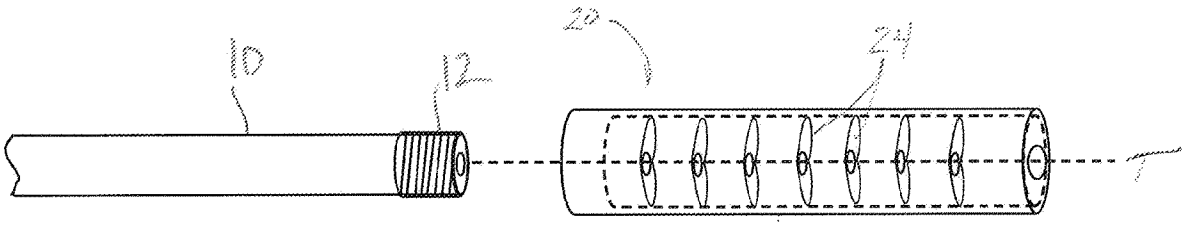
FIG. 1A (Prior Art)
FIGS. 1A-1B illustrate prior art suppressor systems.
Figure 1B:
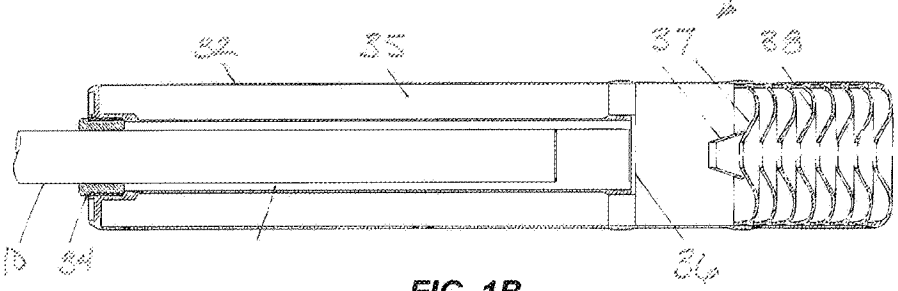
FIG. 1B (Prior Art)
Figure 2:
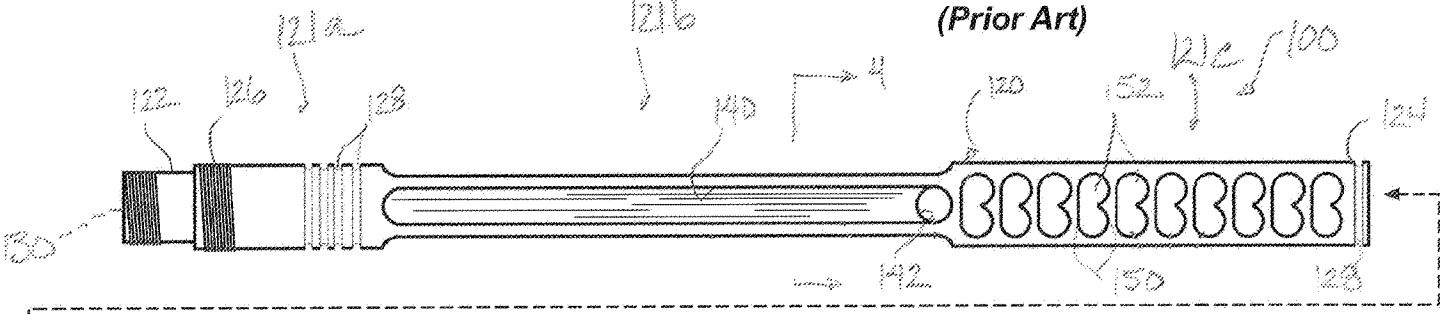
FIG. 2 illustrates an embodiment of a monolithic suppressor barrel according to the present disclosure in a partially disassembled state.
Figure 2:
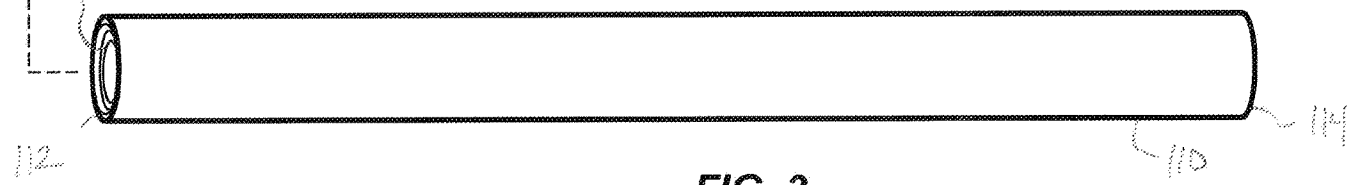

FIG. 2 illustrates an embodiment of a monolithic suppressor barrel 100 in a partially disassembled state. In this embodiment, the barrel 100 includes a sleeve or tubular cover 110 that positions over a barrel piece or body 120. The tubular cover 110 has proximal and distal ends 112 and 114 with a central passage 115 extending therethrough. The cover 110 is configured to fit around the barrel body 120 and may be attached via mating threaded sections 116 and 126 on the cover 110 and barrel body 120, respectively.

When disposed on the barrel body 120, for example, the proximal end 112 attaches or connects near a proximal end 122 of the barrel body 120, while the distal end 114 positions up toward a distal end 124 of the barrel body 120. To hold the cover 110 in place, internal threads of the central passage 115 toward the cover's proximal end 112 can thread to external threads 126 on the barrel body 120, although other features can be used to affix the cover 110. Additionally, the barrel body 120 may include one or more grooves 128 for O-rings, which may serve to form a seal between the barrel body 120 and the cover 110 and to keep those pieces concentric to each other. Additionally, the O-rings may minimize or dampen the contact between the cover 110 and the barrel body 120, which could improve barrel harmonics.

For its part, the barrel body 120 is composed of a monolithic piece of material, such as steel, machined with a number of features disclosed herein. In general, the barrel body 120 has a breech section 121*a* toward the proximal end 122, an intermediate barrel section 121*b*, and a suppressor section 121*c* toward the distal end 124. The breech section 121*a* can have grooves 128 for O-rings or other seals to engage between the exterior of the barrel body 120 and the interior passage 115 of the tubular cover 110. The barrel section 121*b* has one or more channels 140 (e.g., slots, pockets, flutes, etc.) communicating with cross ports 142, and the suppressor section 121*c* has one or more baffles 150. With the tubular cover 110 disposed over the extent of the barrel body 120, the monolithic suppressor barrel 100 can mount to a weapon (not shown), such as a firearm, gun, rifle, artillery, or the like, and the barrel 100 can act to suppress the discharge from firing the weapon.

Figure 3A:
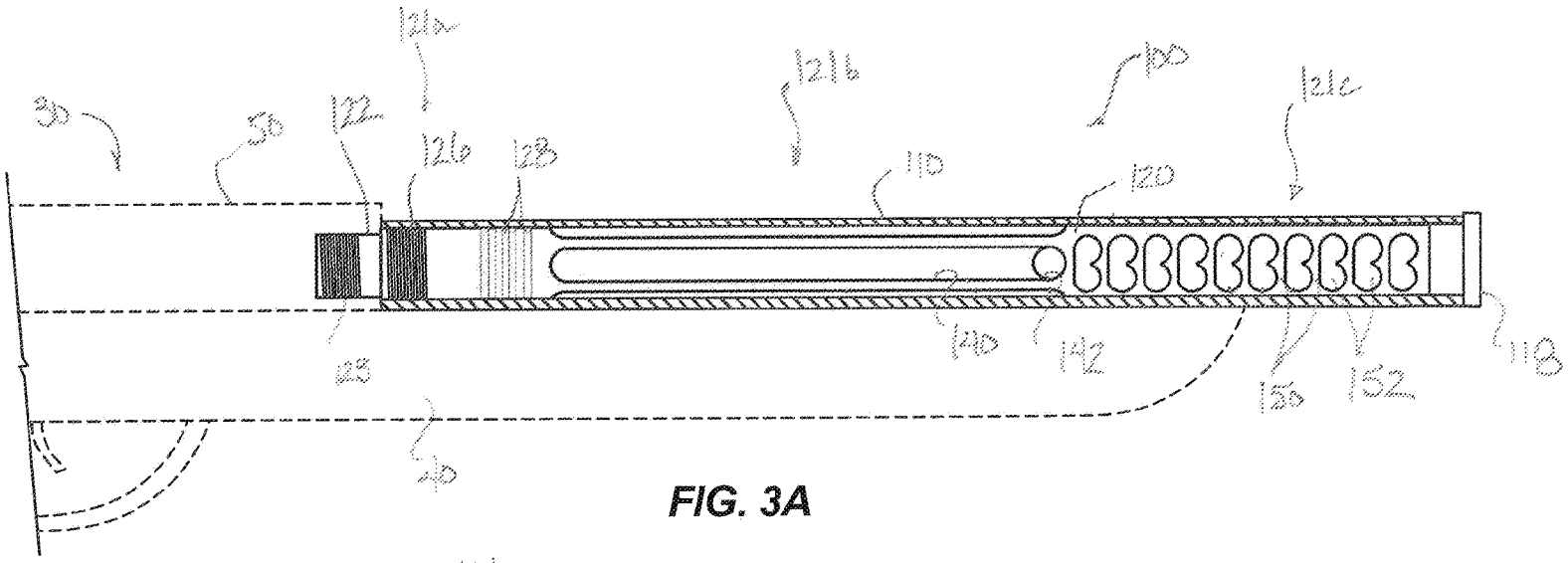
FIG. 3A illustrates the disclosed suppressor barrel disposed on a weapon.
Figure 3B:
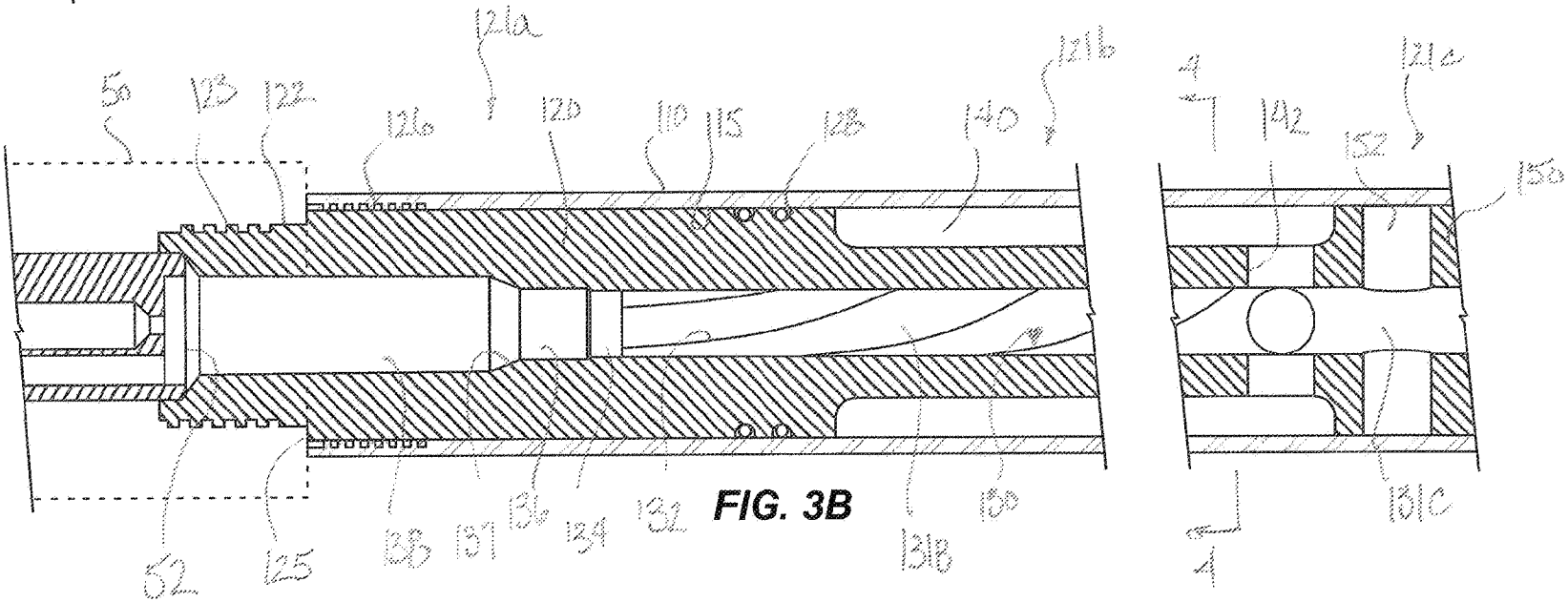
FIG. 3B illustrates details of the disclosed suppressor barrel disposed on the weapon.

Looking at the monolithic suppressor barrel 100 in more detail, FIG. 3A schematically illustrates the disclosed barrel 100 assembled on a weapon 30 (e.g., a rifle), and FIG. 3B illustrates detailed cross-sections of various portions of the disclosed barrel 100 integrated with components of the rifle 30. As shown in FIGS. 3A-3B, the breech section 121*a* is adapted to integrate with a receiver 50 of the rifle 30 and contains a chamber 138 for a round of ammunition. Depending on the type of weapon, the breech section 102*a* may integrate with the gun's receiver 50 using threads 123, as illustrated in FIGS. 3A-3B, or by any other attachment system known in the art.

The barrel section 121*b* defines the one or more channels 140 formed along a length of the barrel body 120. The channels 140 terminate at cross ports 142 at a distance from the breech 121*a*. The cross ports 142 form a muzzle brake, creating a path through which expanding gasses escape from the barrel's bore 130 during firing.

As disclosed herein, various forms and shapes can be used for the channels 140. In the current embodiment, the channels 140 are external flutes 140 formed axially along the exterior surface of the barrel body 120. The one or more flutes 140 are defined along the axis of the barrel body 120 for preferably a near full extent of the barrel section 121*b* to create an extended expansion volume. Increasing the expansion volume from the flutes 140 can be achieved by increasing the number of the flutes 140, the width or depth of the flutes 140, etc. Moreover, the flutes 140 can be increased in length by being defined in a spiral or winding pattern down the length of the barrel body 120.

Finally, the suppressor section 121*c* has the one or more baffles 150, separating a number of expansion chambers 152 from one another. Extending over the extent of the barrel body 120, the cover 110 affixed to the threads 126 near the breech section 121*a* covers and encloses the flutes 140, the cross ports 142, and the expansion chambers 152 of the baffles 150. An end cap 118, threads, or other feature may be provided at the barrel's distal end to further affix the cover 110 on the barrel body 120.

Preferably, the cross ports 142 and the flutes 140 are symmetrically disposed around the circumference of barrel section 121*b*. In general, the number of cross ports 142 and flutes 140 can depend on the circumference of the barrel body 120; a larger barrel body 120 can accommodate more sets of cross ports 142 and flutes 140. For example, the barrel body 120 for a smaller firearm may have four sets of cross ports 142 and flutes 140 (i.e., two pairs disposed opposite each other). The barrel body 120 for a larger firearm (e.g., .50 caliber and above) and artillery may accommodate a greater number of cross ports 142 and flutes 140.

As shown in FIG. 3B, the breech section 121*a* affixes to the receiver 50 of the rifle 30 and can connect by a threaded connection 123. Other forms of connection may be used for different types of weapons. In any event, the breech section 121*a* positions up to the bolt face 52 of the rifle 30. A shoulder 125 on the breech section 121*a* can assist in positioning.

The barrel bore 130 is defined along the extent of the barrel body 120. Towards the breach section 121*a*, the barrel bore 130 defines the chamber 138 for the ammunition. A first shoulder 137 narrows the chamber 138 to a neck 136, which narrows by a second shoulder to a free bore area 134 ahead of the throat to a barrel portion 131*b* of the barrel bore 130. Other weapons may have different chambers 138 and other features. Rifling 132 in the form of lands and grooves are defined inside the barrel portion 131*b*. This rifling 132 continues along the barrel portion 131*b* up to at least the cross ports 142 communicating the barrel bore 130 with the enclosed flutes 140.

Continuing further along the barrel 120, the suppressor section 121*c* contains baffles 150 and has a suppressor portion 131*c* of the barrel bore 130 eventually exiting from the muzzle of the barrel 120. The baffles 150 separate chambers 152, openings, holes, angled walls, etc. machined into the monolithic piece of the barrel body 120. The baffles 150 can have any number of possible shapes and arrangements and are only representatively illustrated here.

As with the flutes 140, the number of baffles 150 may depend on the circumference of the suppressor section 121*c* and/or the length of the barrel body 120. The baffles 150 are generally disposed symmetrically about the circumference. The operation of cross ports 142, the flutes 140, and baffles 150 will be explained in more detail below.

The diameter of cross ports 142 is typically significantly larger than the diameter of the bore 130 through the interior of suppressor section 121*c*. For example, the portion 131*b* of the bore 130 through the barrel section 121*b* of a .308-caliber rifle may essentially be .308-inches in diameter. The bore portion 131*c* through the suppressor section 121*c* may be slightly larger than the barrel's bore portion 131*b* so that the projectile does not inadvertently crash into the walls of the suppressor section 121*c*. According to certain embodiments, about 25 to 30 thousandths of an inch gap exists between the circumferential edges of the projectile and the wall of the bore portion 131*c* in the suppressor section 121*c*. Thus, the bore portion 131*c* through the suppressor section 121*c* configured for a .308 caliber rifle may have a diameter of about .358-inches.

In comparison, the cross ports 142 in the same barrel 100 may have a diameter about 40 to about 60 percent larger than the suppressor's bore portion 131*c*. In the case of a .308-caliber round, the cross ports 142 may have a diameter of about .400 to about .500-inches, for example. Thus, substantially more gas can escape through the plurality of cross ports 142 than enters the bore portion 131*c* through the suppressor section 121*c*.

Figure 4:
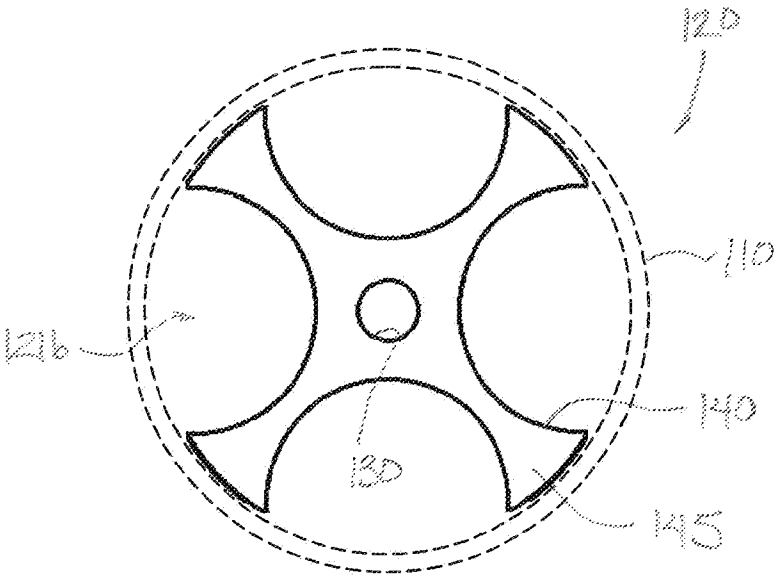
FIG. 4 illustrates an end-sectional view of the disclosed suppressor barrel.

FIG. 4 is an end-sectional view the barrel section 121*b* showing one possible arrangement of flutes 140 disposed around the exterior of the barrel body 120. Here, the body 120 has four flutes 140 formed in the monolithic piece of the body 120 around barrel bore 130. These four flutes 140 make four ribs 145 adjacent which the inside of the tubular cover 110 positions. To further divide the enclosed volumes of the flutes 140, sealing elements can be disposed along the length of the ribs 145 to engage inside the cover 110.

As explained in more detail below, the flutes 140 are made by machining voids into barrel section 121*b*. That machining leaves the ribs 145, which lend strength and stability to barrel body 120 and reduce unwanted harmonics. The fluting not only decreases the weight of the barrel 120, but also increases the surface area, which can have additional benefits.

Figure 5:
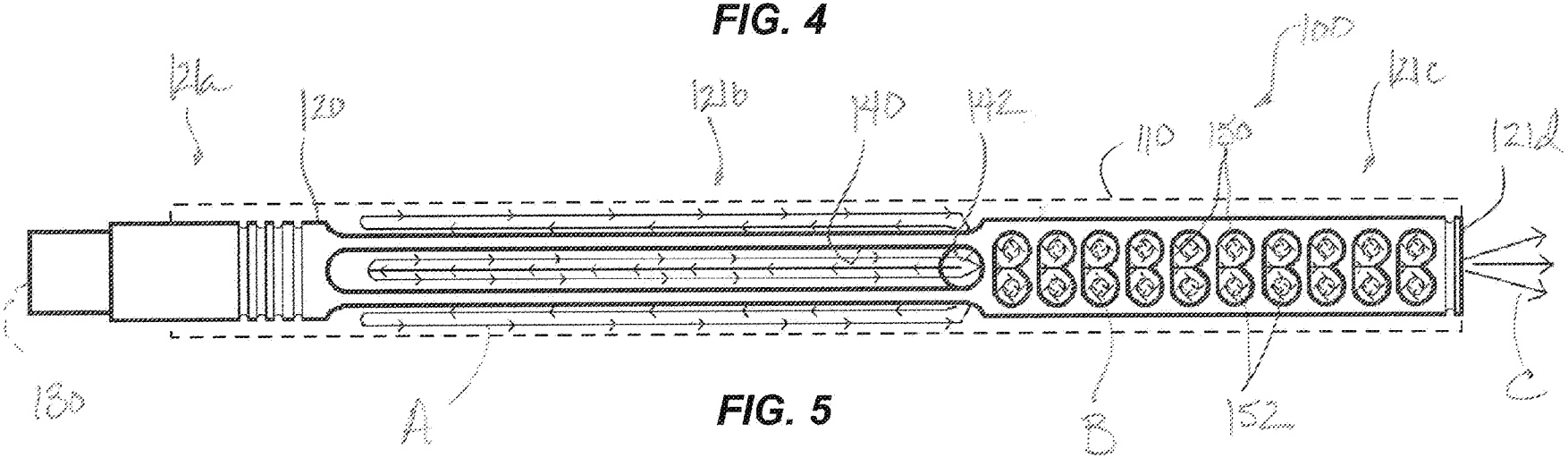
FIG. 5 illustrates gas flow during operation of the disclosed suppressor barrel.

FIG. 5 illustrates the flow of discharge gas during operation of the disclosed barrel 100. For clarity, some of the items already labeled and described with reference to other Figures are not specifically relabeled here, and components to produce the discharge are not depicted. Upon firing, the projectile (e.g., the bullet) travels through barrel bore 130, passes from the barrel section 121*b* into the suppressor section 121*c*, and ultimately leaves the barrel 120 at the muzzle 121*d*. Behind the projectile is a high-pressure wave of rapidly expanding and extremely hot discharge gas. In an unsuppressed rifle, the exit of that gas from a muzzle causes the report of the rifle.

In the suppressor barrel 100 disclosed herein, however, the discharge gas (represented by the lines having arrows indicating direction of flow) is directed through the cross ports 142 as it exits the barrel bore 130 of the barrel section 121*b*.

The flutes 140 then act as expansion chambers, creating space for the expanding gas. The gas cools and slows as it expands. Sound and muzzle flash are thereby reduced. The expansion volume defined between the cover 110 and the barrel section 121*b* may be greater than the expansion volume between the suppressor section 121*c* and the cover 110. Thus, the gas expands preferentially toward the breech section 121*a* until it reaches near the end of the flutes 140, the O-rings, or other seals that are disposed at the proximal end of the system 100.

Having expanded into and pressurized the volume between the barrel section 121*b* and the cover 110, the gas continues to expand into the bore portion 131*c* of the suppressor section 121*c*. As the gas passes through the suppressor's bore portion 131*c*, the baffles 150 further slow the expansion, creating eddies and vortices in the chambers 152 and diverting the gas off its centerline of expansion. The gas then exits the end of suppressor section 121*c* out the muzzle 121*d* at greatly reduced pressure.

Figure 6A:
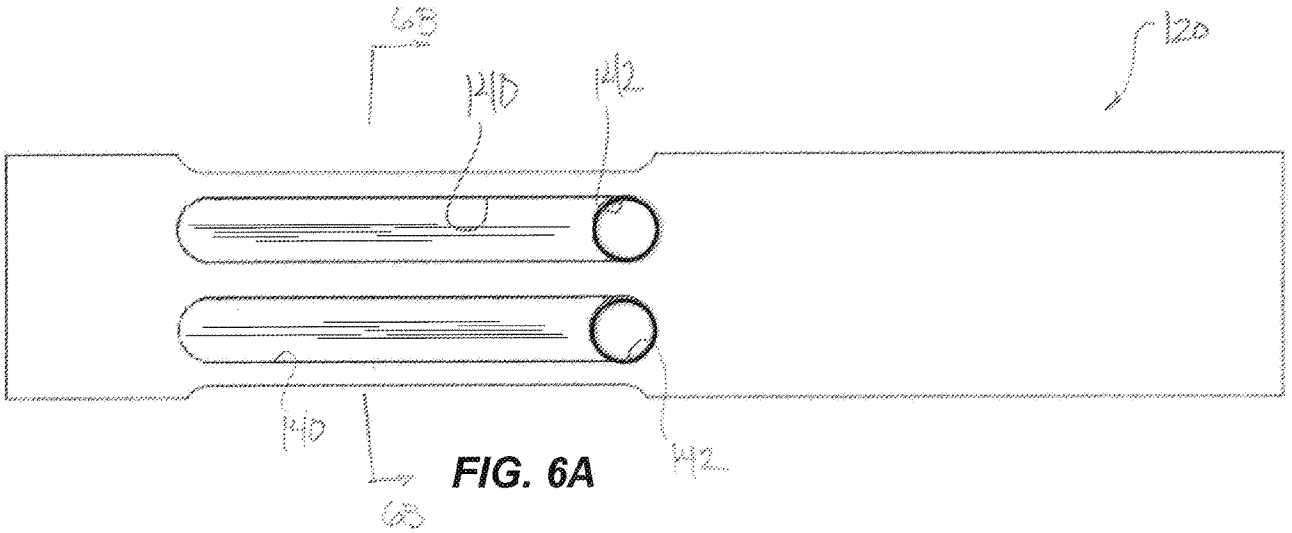
FIGS. 6A-6B illustrate a side view and an end-sectional view of an alternative embodiment of the disclosed suppressor barrel.
Figure 6B:
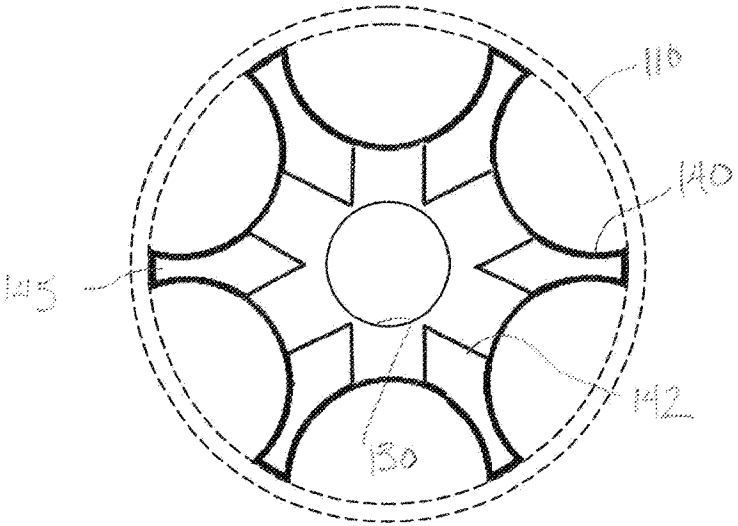

The number, length, volume, size, and other features of the flutes 140, cross ports 142, and baffles 150 can be configured and machined on the disclosed suppressor barrel 100 to achieve an amount of desired suppression, accommodate different ammunitions, adapt to different weapons, dissipate heat, deal with vibrations, etc. For example, the barrel 120 depicted in the side view of FIG. 6A and the end-section view of FIG. 6B has six cross ports 142, flutes 140, and ribs 145. As mentioned above, the diameter of the barrel section 121*b* and the round generally limit the number of cross ports 142 and flutes 140 that the barrel body 120 can accommodate. Yet, more or less flutes 140, cross ports 142, and the like can be configured, arranged, and sized as needed depending on the implementation.

Figure 7:
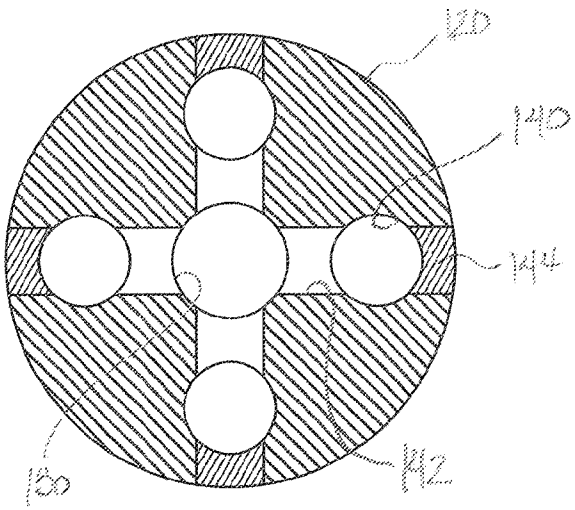
FIG. 7 illustrates an end-sectional view of yet another embodiment of the disclosed suppressor barrel.

As will be appreciated, the baffles 150 may typically require a tube or can, such as provided by the external cover 110 disclosed herein, to enclose the chambers 152. All the same, it may be possible to machine the channels 140 as longitudinal slots or holes fully enclosed in the interior of the barrel body 120 parallel to the barrel bore 130, rather than as external flutes requiring separate enclosure from a cover. For example, FIG. 7 shows an end section of the barrel body 120 with such parallel channels 140, slots, or pockets enclosed in the interior of the barrel body 120. In this case, use of the external cover 110 to enclose the channels 140 may not be necessary. Cross ports 142 can be defined through the barrel body 120 to the barrel bore 130 to communicate with the channels 140, and the external ends of the cross ports 142 can be capped or plugged with an element or material 144. As will be appreciated, machining elongated channels 140 offset from barrel bore 130 presents much more complexity than defining open channels 140 as in the form of the flutes in previous embodiments on the barrel body's external surface and enclosing those flutes 140 with the cover 110. For this reason, use of the cover 110 on the barrel 100 may be preferred to enclose externally formed flutes for the channels 140.

Some weapons require manual loading of bullets into the chamber of the barrel. Other weapons have loading mechanisms that are gas-operated and use gases from the barrel to charge the mechanisms. The disclosed suppressor barrel 100 can be configured to operate with these types of gas-operated loading mechanisms.

Figure 8A:
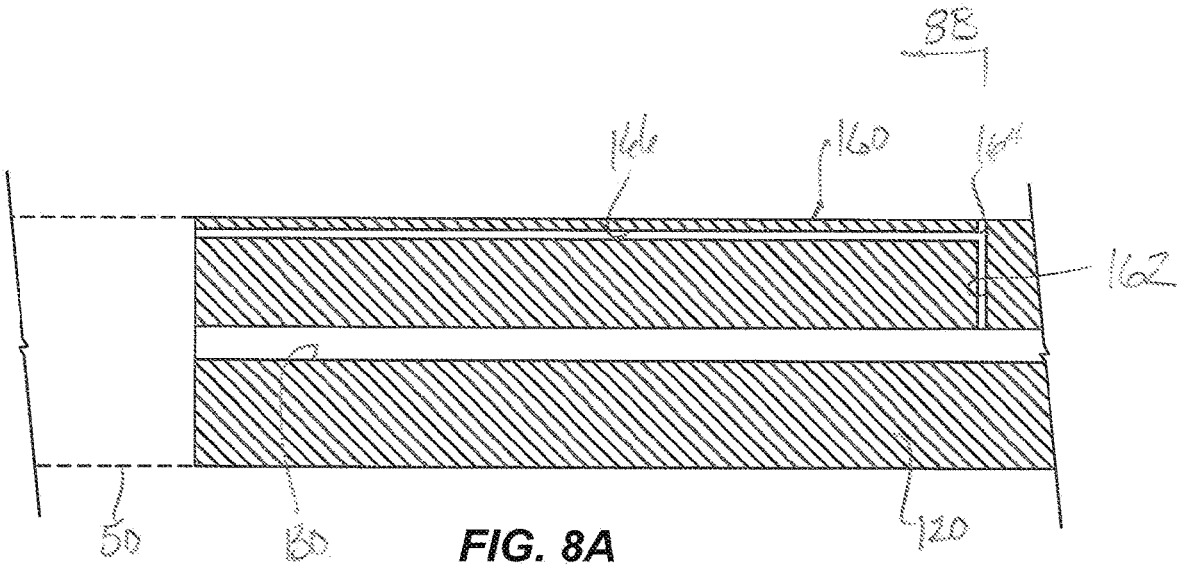
FIGS. 8A-8B illustrate cross-sectional and end-sectional views of an embodiment of a monolithic suppressor barrel configured for a firearm having a gas-operated loading action.
Figure 8B:
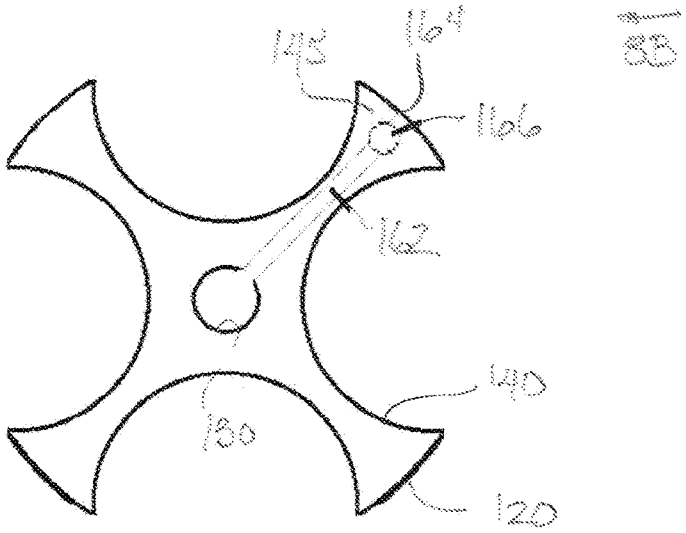

For example, FIG. 8A illustrates an alternative embodiment of a monolithic suppressor barrel 100, which includes a gas port 160 to allow operation of a rifle employing a gas-operated loading mechanism. Examples of such rifles include various automatic/semiautomatic small arms, such as the M-16/AR-15 series of rifles. As shown in the cross-section of FIG. 8A and the end-section of FIG. 8B, the bore 130 is configured with a tap 162 to communicate or vent some of the expanding gas from the bore 130 toward the exterior of the barrel 120. A longitudinal port 166 defined along the length of the barrel 120 in a rib 145 directs the vented gas toward the loading mechanism (i.e., the action) of the receiver 50 to cycle the (semi)-automatic capabilities. Due to machining requirements, a plug 164 or seal may be needed at the connection of the tap 162 and port 166.

Figure 8C:
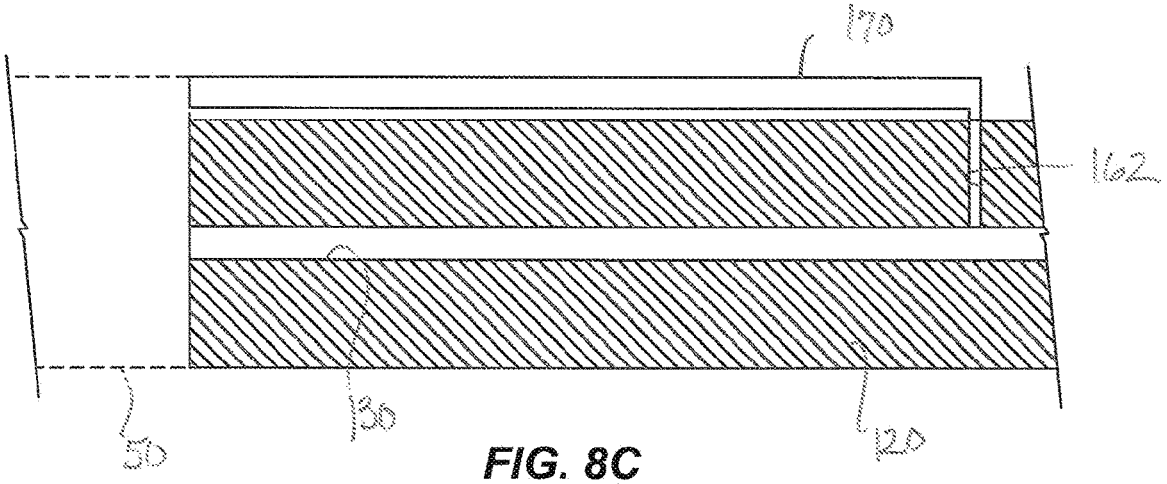
FIG. 8C illustrates a cross-sectional view of another embodiment of a monolithic suppressor barrel configured for a firearm having a gas-operated loading action.

Rather than having an internal port for vented gas, the barrel 120 can include external components. For example, FIG. 8C shows the barrel body 120 in cross-section having a vent tap 162 communicating from the barrel bore 130. The tap 162 connects with an external line 170, which feeds the gas to the action of the receiver 50. Any suitable form of line 170 conventionally used for cycling the gas can be used.

In the embodiments of the disclosed suppressor barrel 100, the barrel body 120 is composed of a monolithic piece of material having a tubular cover 110 disposed about the exterior. The monolithic piece of the body 120 defines at least the barrel bore 130, the one or more cross ports 142, and the one or more channels or flutes 140 integrally therein. The monolithic piece of the body 120 also defines the one or more baffles 150 integrally formed therein. The tubular cover 110 encloses the one or more channels or flutes 140 and the one or more chambers 152 of the baffles 150. This arrangement is well suited for manufacture and assembly.

For instance, use of the external cover 110 facilitates assembly of the disclosed barrel 100. In essence, the barrel body 120 can be a pre-machined barrel blank suitable for the firearm on which it is to be used. As such, the various features of the chamber 138, shoulders 137, bore 130, rifling 132, etc. can be pre-machined on the blank according to the weapon manufacturer's requirements. In this way, an advantage of the monolithic barrel 100 having an integral suppressor as disclosed herein is that the entire barrel and suppressor monolith can be machined from a single barrel blank.

To configure the pre-machined blank for use as the disclosed barrel 100, the barrel bore 131*c* of the bore is reamed to increase its diameter. The flutes 140, the cross ports 142, and the chambers 152 separated by the baffles 150 are machined integrally into the blank to form the features of the breech section 121*a*, the barrel section 121*b*, and the suppressor section 121*c*. Threads 126 can be machined on the exterior along with seal grooves 128 and other features. The tubular cover 100 is then used to enclose the baffle chambers 152 and the flutes 140. As the entire assembly is a single piece of material, it overcomes the drawbacks associated with mechanically joining a suppressor to a barrel, as described above.

Figures 9A, 9B, 9C, 9D:
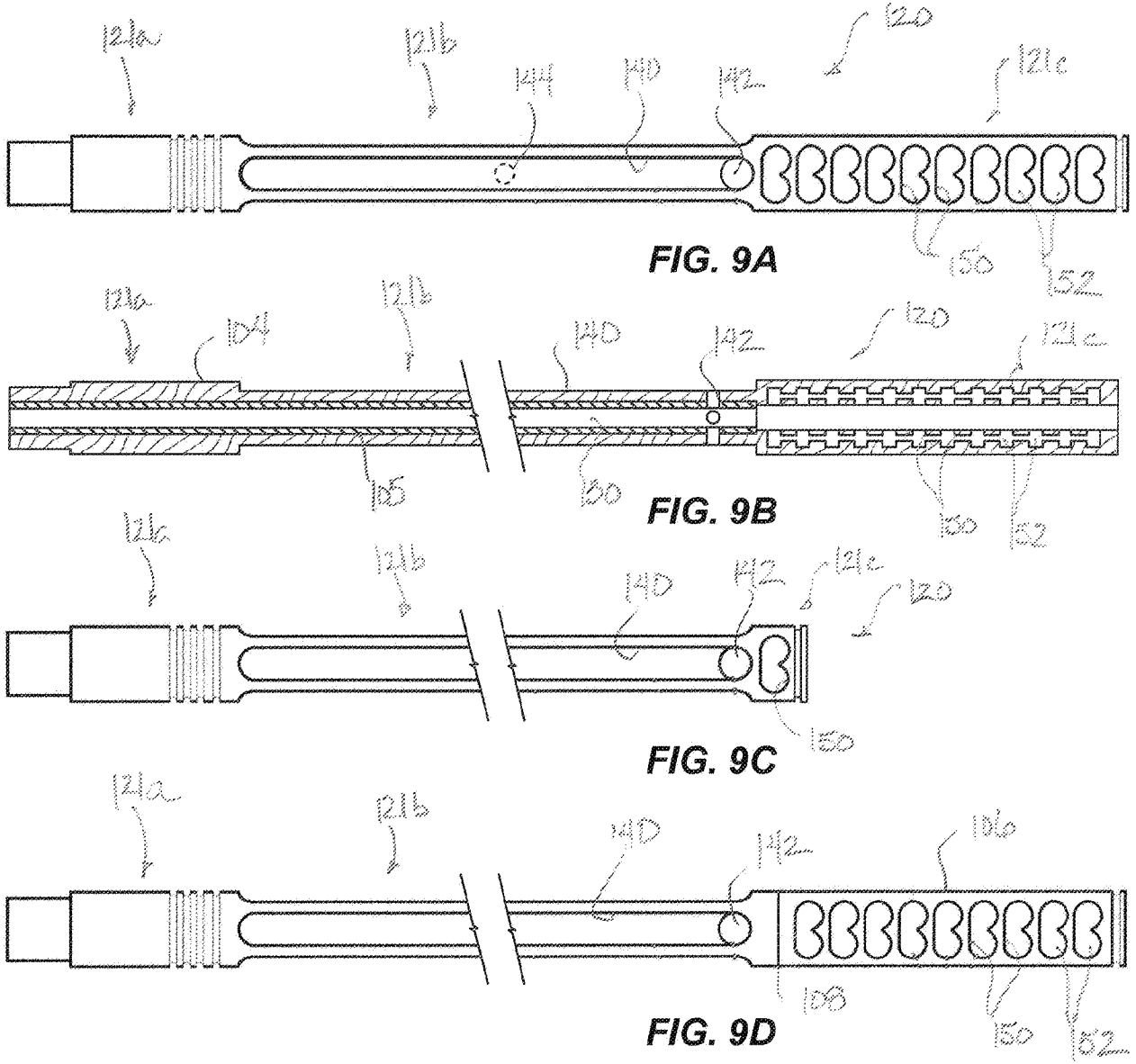
FIGS. 9A-9D illustrate alternative configurations for the disclosed suppressor barrel of the present disclosure.

Other arrangements can be used for the disclosed suppressor barrel 100. For example, FIG. 9A illustrates the barrel body 120 having the channels or flutes 140 as before. As noted above, the cross ports 142 for communicating discharge gas to the flutes 140 can be defined toward the distal end of the barrel section 121*b*. This allows a significant length of the barrel bore 130 to include continuous rifling. The cross ports 142 can be placed elsewhere, and each of the flutes 140 can have more than one cross port 142. For example, FIG. 9A depicts one possible location for a cross port 144 that can be used in conjunction with (or instead of) the distal cross port 142. Any of the other flutes 140 can have similar cross ports 144 in this or other locations.

In previous embodiments, the barrel body 120 is composed of a monolithic piece of material, which is typically steel. This is not strictly necessary. Instead, as shown in FIG. 9B, the majority of the barrel's body 120 can be composed of a first material 104, which can be a material other than steel. Some examples for the first material 104 can include plastic, composite, metal other than steel (e.g., aluminum), a different type of steel, or other types of materials. Disposed internal to this first material 104, the barrel body 120 includes a bore insert 105 that forms the barrel bore 130 for the barrel body 120. This bore insert 105 can be made of the requisite material (i.e., steel) with proper rifling, chamber, and other features.

Although more than one baffle 150 may be preferred, the number of baffles 150 used can vary. As a brief example, FIG. 9C illustrates one chamber 152 from baffle(s) 150 formed on the barrel body 120 at the end of the barrel section 121*b*. Although the benefits from baffling may be diminished with this arrangement, the barrel 100 can still operate according to its intended purpose.

With that said, it is possible for the disclosed barrel 100 to lack baffling altogether toward the muzzle. Instead, the distal end of the barrel section 121*b* can terminate with the flutes 140 (and with the cross ports 142 if so placed). In this context, the disclosed barrel 120 can still operate according to its intended purpose because the flutes 140 and cross-ports 142 achieve some of the suppression.

Moreover, as shown in FIG. 9D, the baffles 150 can be included in a separate suppressor section 106 that connects to the distal end of the barrel section 121*b* of the barrel body 120. Any conventional type of connection 108 (i.e., threaded, telescopic, etc.) can be used between the barrel section 121*b* and the separate suppressor section 106. In this context, the suppressor section 106 can be of conventional design having a can or cover with a chamber containing internal baffles. In this case, the breech section 121*a* and the barrel section 121*b* can be integrally formed of a first material (e.g., steel), while the baffle section 121*c* can be composed of a second, different material (e.g., aluminum).

Previous embodiments, such as in FIGS. 3A-3B, have shown one way to affix the barrel 100 to the receiver 50. As already noted, barrels can affix to receivers in a number of ways, and the features of the disclosed barrel 100 can be adapted to the different forms of affixing. As one additional example, FIG. 10 illustrates a configuration of the disclosed suppressor barrel 100 arranged for use with one particular type of riffle, such as an M16/AR-15 type of firearm.

Figure 10:
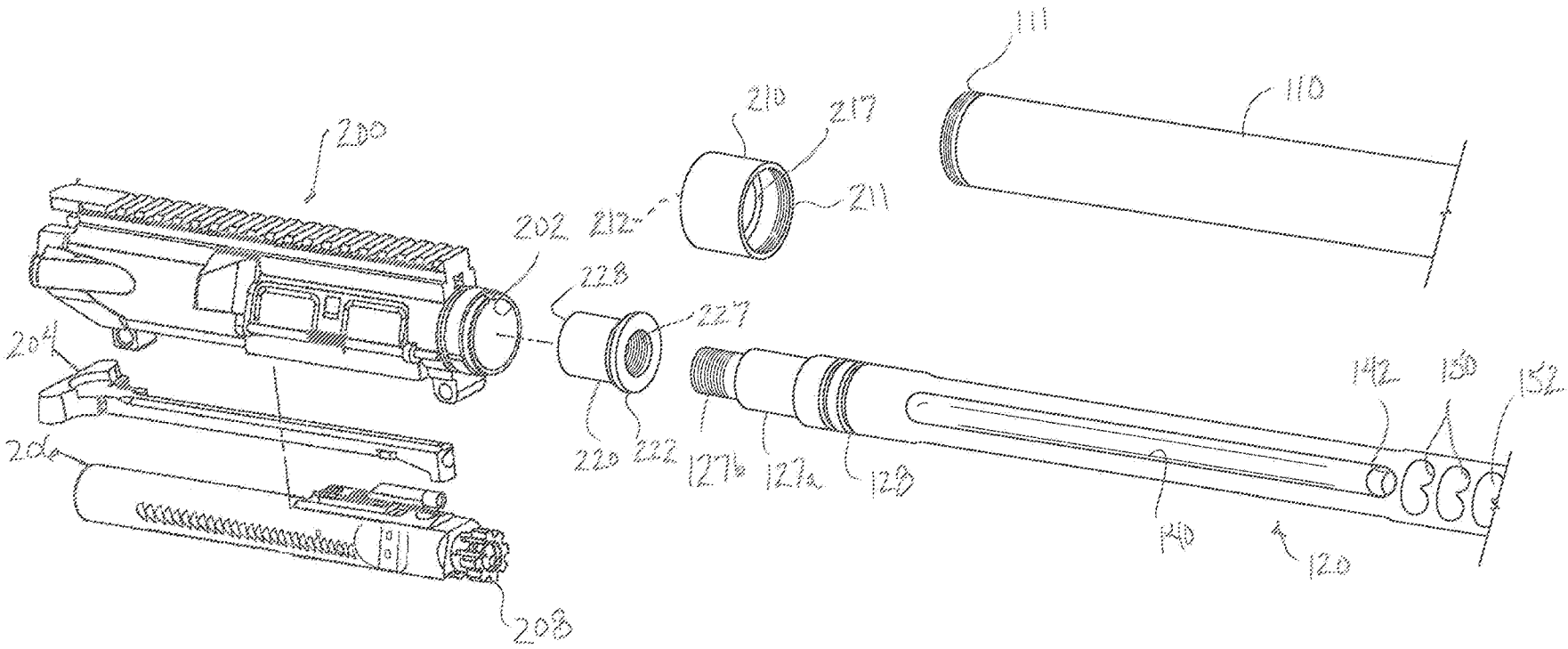
FIG. 10 illustrates a configuration of the disclosed suppressor barrel arranged for use with one particular type of riffle.

In FIG. 10, the upper receiver 200 of the riffle is shown, and various other components, such as the lower receiver and the like, are omitted. The upper receiver 200 holds a charging handle 204 and a carrier 206 therein. The barrel body 120 of the present disclosure can have many of the features disclosed herein, such as the channel or flutes 140, cross ports 142, baffles 150, etc. The barrel body 120 may also have seal slots 128.

In addition to these and other previously described features, the proximal end of the barrel body 120 includes a narrow relief or end 127*b* and a threaded tip 127*b* on which a barrel nut 210 and a barrel extension 220 are used to assemble the barrel body 120 to the receiver 200. In particular, the barrel nut 210 fits onto the narrow end 127*a* of the barrel body 120. This is done because the inner-shouldered opening 217 of the barrel nut 210 is too small to fit down along the length of the barrel body 120 as conventionally done. With the barrel nut 210 first fit onto the narrow end 127*a*, the barrel extension 220 then attaches onto the narrow end 127*a*. As can be seen, the barrel extension 220 has internal threads 227 to mate with the threaded tip 127*b* of the barrel's end 127*a*.

With the barrel extension 220 installed, the barrel nut 210 is now trapped on the end 127*a* by the extension's shoulder 222. At this point, the barrel extension 220 fits into the front opening 202 of the upper receiver 200 so that the extension's face 228 mates with the bolt end 208 of the carrier 206 inside the receiver 200. Internal threads 212 in the barrel nut 210 then threads to the receiver 200 at the opening 202, and the internal shoulder 217 of the nut 210 engages against the extension's shoulder 222 to hold the barrel body 120 in place.

Finally, the barrel cover 110 can slide down along the length of the barrel body 120, and a threaded lip 111 on its end can thread to internal threads 211 inside the barrel nut 210. Various other elements (not shown) can also be assembled to support other components, such as a hand guard, heat shields, liners, caps, a gas tube, etc.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of making a gun barrel comprising an integrated suppressor, the method comprising:

providing a barrel blank comprising:

a breach end, a muzzle end, a long axis, an exterior surface, and a bore extending through the barrel blank along the long axis from the breach end to the muzzle end and having a first diameter, forming a suppressor section and a barrel section in the barrel blank, wherein the suppressor section extends from the muzzle end to a first location along the barrel blank and the barrel section extends from the first location to the breach end, wherein forming the suppressor section and a barrel section comprises:

reaming the bore within the suppressor section so that the bore within the suppressor section has a second diameter that is greater than the first diameter, and machining a plurality chambers within the suppressor section, wherein the chambers extend through the barrel blank perpendicular to the long axis, thereby forming baffles in the barrel blank.

2. The method of claim 1, further comprising machining two or more cross ports in the barrel blank, wherein the cross ports extend through the barrel blank and the bore perpendicular to the long axis.

3. The method of claim 2, further comprising machining two or more elongated voids in the exterior surface of the barrel blank parallel to the long axis.

4. The method of claim 3, wherein at least a portion of at least one of the voids is co-located with one of the two or more cross ports.

5. The method of claim 2, wherein a portion of the bore at the breach end defines a chamber configured to accept ammunition.

6. The method of claim 5, wherein the bore within the barrel section comprises rifling and wherein the bore in the suppressor section does not comprise rifling.

7. The method of claim 6, wherein the rifling within the barrel section extends from the chamber to the two or more cross ports.

8. The method of claim 1, wherein the bore extending through the barrel blank comprises a wall and is configured to accommodate a projectile of a predetermined caliber, and wherein the second diameter is configured so that when the projectile is fired through the bore, edges of the projectile do not the wall within the suppressor section.

9. The method of claim 8, wherein the second diameter is configured to provide a gap of about 25 to about 30 thousands of inch between the wall and the edges of the projectile.

10. The method of claim 1, further comprising machining a first set of threads into the barrel blank proximate to the breach end.

11. The method of claim 10, wherein the first set of threads is configured to attach the barrel blank to a receiver of a gun.

12. The method of claim 11, further comprising machining a second set of threads into the barrel blank proximate to the breach end.

13. The method of claim 12, wherein the second set of threads is configured to attach a tubular cover to the barrel blank.

14. The method of claim 13, further comprising machining one or more grooves in the barrel blank proximate to the breach end, wherein the one or more grooves are configured to receive O-rings for sealing between the tubular cover and the barrel blank.

* * * * *